United States Patent [19]

Flatau

[11] Patent Number: 4,742,774

[45] Date of Patent: May 10, 1988

[54] SMALL ARMS AMMUNITION

[76] Inventor: Abraham Flatau, 2004 Stockton Rd., Joppa, Md. 21085

[21] Appl. No.: 520,274

[22] Filed: Jun. 20, 1983

Related U.S. Application Data

[63] Continuation-in-part of Ser. No. 082,264, Oct. 5, 1979, abandoned.

[51] Int. Cl.[4] ..... F42B 11/00

[52] U.S. Cl. ..... 102/439; 102/501; 102/503; 102/532

[58] Field of Search ..... 102/501, 517–519, 102/364, 503, 439, 524, 532

[56] References Cited

U.S. PATENT DOCUMENTS

| | | | |
|---|---|---|---|
| 590,428 | 9/1897 | Bennett | 102/503 |
| 1,103,740 | 7/1914 | Cooper | 102/503 |
| 1,149,679 | 8/1915 | Parker | 102/503 |
| 1,292,388 | 1/1919 | Bowers | 102/503 |
| 2,324,551 | 7/1943 | Albree | 102/503 |
| 2,386,054 | 10/1945 | McGee | 102/503 |
| 2,433,334 | 12/1947 | Birkeland | 102/503 |
| 3,022,734 | 2/1962 | Kidder . | |
| 3,024,729 | 3/1962 | Kluge | 102/503 |
| 3,599,568 | 3/1965 | Shellnutt et al. | 102/455 |
| 4,301,736 | 11/1981 | Flatau et al. | 102/503 |

FOREIGN PATENT DOCUMENTS

| | | | |
|---|---|---|---|
| 1578115 | 4/1971 | Fed. Rep. of Germany | 102/517 |
| 1033 | of 1853 | United Kingdom | 102/503 |
| 19912 | of 1893 | United Kingdom | 102/503 |

*Primary Examiner*—Harold J. Tudor

*Attorney, Agent, or Firm*—Robert P. Gibson; Edward Goldberg; Edward F. Costigan

[57] ABSTRACT

Improved small arms ammunition comprising a conventional primed cartridge case and a hollow projectile in tubular geometric form is provided according to the present invention. In accordance with the teachings of this invention, the hollow projectile in tubular geometric form is characterized by a nose of circular cross-section expanding back to the main body of the projectile. The main body of the projectile includes a rotational band about at least a portion of the periphery thereof and is backed by a pusher disc and obturator to seal off the central core of the projectile so that propulsive force may be imparted thereto. The tubular projectile is lighter than its comparable conventional counterparts, exhibits gyroscopic stability and is capable of being fired at higher muzzle velocities and producing less recoil than that associated with conventional small arms ammunition while at the same time depositing a great amount of kinetic energy upon impacting the target.

3 Claims, 2 Drawing Sheets

SMALL ARMS AMMUNITION

GOVERNMENTAL INTEREST

The invention described herein may be manufactured, used, and licensed by or for the Government for governmental purposes without the payment to me of any royalties thereon.

CROSS-REFERENCE TO RELATED APPLICATION

This application is a continuation-in-part of copending application, Ser. No. 082,264, filed Oct. 5, 1979, now abandoned.

BACKGROUND OF THE INVENTION

This invention relates to improvements in small arms ammunition and more particularly to improved small arms ammunition having a conventional primed cartridge case and a hollow projectile in tubular geometric form.

While the present invention is of general application to all forms of ammunition and small arms ammunition in particular, the same was developed in connection with a program to improve the accuracy and effectiveness of the M1911A1 caliber 0.45 U.S. pistol and hence the invention and more particularly the preferred embodiment set forth herein will be described in association with a discussion of this weapon. However, as will be readily appreciated by those of ordinary skill in the art, the concepts for improvement of ammunition herein disclosed are fully applicable to all forms of small arms ammunition and will have special application to hand weapons, such as pistols for personal defense and to manual weapons of relatively light weight used against lightly armored human targets wherein the novel ammunition enhances the terminal effectiveness of conventional rounds without any modification of such weapons.

The M1911A1 caliber 0.45 U.S. pistol is not generally viewed as an accurate weapon when the same is employed by the average soldier. The weapon is structurally sound and the standard projectile, weighing 230 grains is launched at approximately 860 ft/sec muzzle velocity. Due to the weapon's mechanical strength and the fact that large quantities of this weapon have been produced, distributed, and stockpiled, it would be highly advantageous to maintain the weapon in its current form but to design new ammunition employing a standard cartridge case and primer, which would improve the weapon's effectiveness by increasing the kinetic energy delivered to the target.

While numerous studies have been directed to the M1911A1 caliber, 0.45 U.S. pistol, these studies have tended to place more emphasis on the weapons functional characteristics than on the projectile employed therein. For instance, the U.S. Army Small Arms Organization investigated the performance characteristics of various components within the weapon such as the time displacement history of the slide, the hammer fall, the peak total resistance to recoil, and slide and frame impact. Additionally, an instrumented test arrangement was employed to measure the three forces and the three moments acting about the three orthogonal coordinate axis of the weapon during firing.

Further, biophysics or wound ballistic testing and analysis revealed that the standard caliber 0.45 projectile often fails to deposit a substantial portion of its kinetic energy upon hitting an unprotected (normally clothed) individual. Thus, although the projectile made a relatively large wound track, the projectile would not expend sufficient energy within the target media and hence could exit the target with a substantial amount of retained energy. Additionally, recent testing has also shown that the new Kevlar body armor will prevent the standard 0.45 caliber projectile from penetrating both the Kevlar material and the body, even when the same impacts at muzzle velocity. The standard caliber 0.45 projectile also cannot penetrate the new Kevlar helmet.

While these studies may have provided more detailed information about the interaction of the weapon's components and the effectiveness of the projectile fired thereby, none of the studies have led to a successful improvement in the weapon's effectiveness and its wound ballistic capability in the hands of the average soldier.

Therefore, it is an object of this invention to provide improved small arms ammunition capable of being employed in conventional weapons, especially pistols.

A further object of this invention is to provide small arms ammunition exhibiting markedly improved accuracy and effectiveness characteristics.

An additional object of this invention is to provide improved small arms ammunition capable of high muzzle velocity.

Another object of this invention is to provide improved small arms ammunition exhibiting higher energy deposit characteristics in unprotected target media.

A further object of this invention is to provide improved small arms ammunition capable of penetrating currently available body armor without a significant loss in target penetration.

An additional object of this invention is to provide improved small arms ammunition exhibiting markedly reduced recoil characteristics.

Various other objects and advantages of the present invention will become clear from the following detailed description of an exemplary embodiment thereof, and the novel features will be particularly pointed out in conjunction with the claims appended hereto.

SUMMARY OF THE INVENTION

In accordance with the teaching of the present invention, improved small arms ammunition including a conventional primed cartridge case and hollow projectile in a tubular geometric form is provided. The tubular projectile includes a cylindrical body portion and a nose of circular cross-section expanding back to the body portion. The body portion has a rotational band about a portion of its periphery, and is backed by an obturator or pusher disc sealing off the tubular hollow of the projectile so that propulsive force may be imparted thereto.

BRIEF DESCRIPTION OF THE DRAWINGS

The invention will be more clearly understood by reference to the following detailed description of an exemplary embodiment thereof in conjunction with the accompanying drawings in which:

FIGS. 1A–1C illustrate a conventional caliber 0.45 ball round according to the prior art wherein FIG. 1A is a sectional view showing the round in an assembled condition, FIG. 1B is a sectional view showing the details of the primed cartridge case, and FIG. 1C is a sectional view showing the details of the caliber 0.45 ball projectile;

FIGS. 3A and 3B illustrate details of an exemplary tubular projectile means employed within the embodiment of the invention shown in FIG. 2 wherein FIG. 3A is a sectional side view of the tubular projectile and FIG. 3B is a front view thereof;

FIGS. 4A and 4B illustrate the details of an exemplary pusher disc employed within the embodiment of the invention shown in FIG. 2 wherein FIG. 4A is a front view of the pusher disc and FIG. 4B is a side view thereof;

FIGS. 5A and 5B illustrate the details of an exemplary obturator means employed within the embodiment of the invention shown in FIG. 2, wherein FIG. 5A is a front view of the obturator means and FIG. 5B is a side view thereof.

DETAILED DESCRIPTION OF THE PREFERRED EMBODIMENT

Figure 1B:
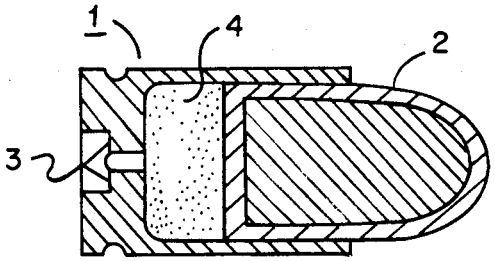
Figure 1B:
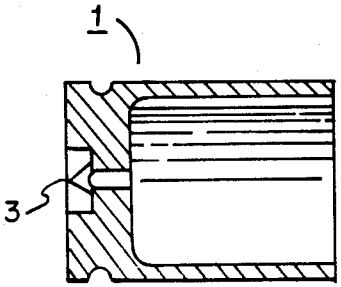
Figure 1C:
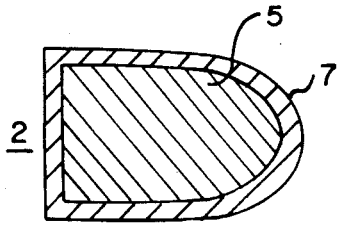
FIG. 1C PRIOR ART

Referring now to the drawings and more particularly to FIGS. 1A-1C thereof, there is shown a conventional caliber 0.45 ball round. As will be readily appreciated by those of ordinary skill in the art, the conventional caliber 0.45 ball round illustrated in FIG. 1A comprises a primed cartridge 1 having a ball round 2 disposed therein. The primed cartridge 1 is separately illustrated in FIG. 1B while the ball round is best shown in FIG. 1C. The primed cartridge 1 has a primer 3 disposed in the rear portion thereof so that the ammunition round may be fired upon striking of the primer 3 by the weapon's firing pin and is provided with suitable propellant 4 disposed within the primed cartridge 1 intermediate the ball round 2 and the primer 3. The ball round 2 employed within the conventional caliber 0.45 round illustrated in FIG. 1A, weighs approximately 230 grains and has a lead alloyed core 5 about which is disposed gilded metal jacket 7 generally made of copper or the like.

Upon firing of the conventional caliber 0.45 round illustrated in FIG. 1A, the same is generally launched at approximately 860 ft-sec from a primed casing utilizing approximately 5 grains of propellant. In use in the M1911A1 caliber 0.45 U.S. pistol, the same produces a rather notorious recoil and, as aforesaid, this weapon is not viewed as being highly accurate when used by the average soldier. Furthermore, biophysics or wound ballistic testing and analysis has revealed that the conventional caliber 0.45 projectile deposits only a fraction of its kinetic energy upon hitting an unprotected or normally clothed individual. Thus, while the ball round 2 may produce a relatively large wound track, the projectile does not expend sufficient energy within the human target media and will exit the target retaining a reasonable amount of energy.

Figure 2:
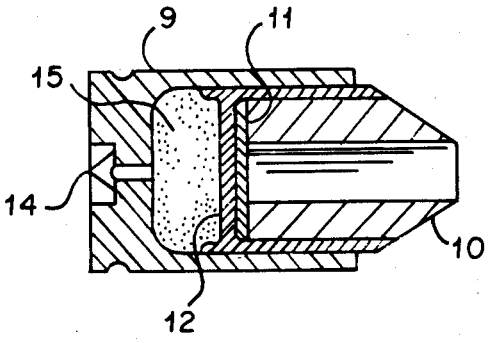
FIG. 2 is a sectional illustration of a preferred embodiment of the improved small arms ammunition according to the present invention.

Referring now to FIG. 2, there is shown in sectional view an exemplary embodiment of the improved small arms ammunition according to the present invention. It will be appreciated from the description set forth above that the exemplary embodiment of the invention set forth herein has application to all forms of small arms ammunition even though the same is disclosed in association with a caliber 0.45 round. The improved small arms ammunition round illustrated in FIG. 2 comprises a primed cartridge 9, elongate tubular projectile means 10, pusher disc 11, obturator means 12, primer 14, and propellant 15. The primed cartridge 9 may take identically the same form as that employed in a conventional caliber 0.45 ball round as illustrated in FIG. 1B and hence is provided with primer 14 and propellant 15. The primer 14 may take the same form as that employed in a conventional round; however, the propellant 15 is modified to be faster burning due to the lighter projectile employed, as shall be described hereinafter. Typical of suitable commercially available propellants are propellants sold under the marks "Bulls Eye" and "Red Dot" as marketed by the Hercules Powder Company.

Figure 3A:
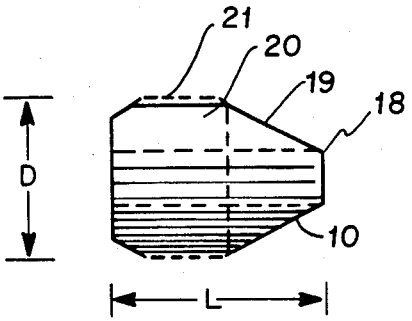
Figure 3B:
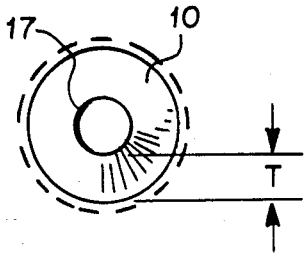

The tubular projectile means 10 is best shown in FIGS. 3A and 3B wherein FIG. 3A is a sectional side view of the tubular projectile means 10 and FIG. 3B is a front view thereof. Turning now to FIGS. 3A and 3B, the tubular projectile means 10 is of tubular geometry and in the case of a caliber 0.45 projectile will have a diameter D which corresponds to the diameter of the projectile 2 illustrated in FIG. 1C which has a nominal dimension corresponding to 0.450 inches. However, as will be apparent to those of ordinary skill in the art, ammunition for other small caliber weapons will have projectiles whose diameter D corresponds to the caliber or millimeter rating of that weapon. However, it is of critical importance in all cases that the length of the tubular projectile means 10 is preferably such that the projectile length to diameter ratio is not greater than 1.75 to 1, with a preferred limit of 1.5 to 1. While some downward variation in this ratio is permissable, in no case should the ratio exceed 1.5 to 1. This is due to the fact that this ratio reduces the moment arm between the projectile center of gravity and its center of pressure.

The tubular projectile means 10 is preferably fabricated of a hard or tough material such as steel having a Rockwell hardness Rc of 45 or greater, high density materials, powder alloys, or various types of high strength composite materials have an Rc not less than 45. The tubular projectile has a relatively sharp leading edge 18 which is capable of a cutting action upon target impact that is not possible with the hemispherical or ogive nose shaping of a conventional projectile. In addition, the conventional "hollow-point" or "dum-dum" bullet has a relatively soft nose and upon impact with target armor or an unprotected target, the nose tends to deform or mushroom. By contrast, biophysic testing revealed that the hard material of the tubular projectile means coupled with the sharp annular leading edge formed by the circular edge 18 does not exhibit this characteristic in that the projectile means 10 does not mushroom or deform but maintains its shape while penetrating body armor and/or body tissue simulant.

The inner diameter of circular edge 18 substantially corresponds in diameter to the diameter of hollow core 17. From the circular edge 18, the tubular projectile 10 expands at a leading edge angle, indicated by the aslantly disposed surface 19, at an angle designed to allow individual rounds to be fed from a magazine without causing a weapon jam and to cause the tubular projectile 10 to exhibit a relatively low drag coefficient. The taper of the aslantly disposed surface 19 may be selected in the range of from 12 to 25 degrees with respect to the horizontal and more specifically within a preferred range or approximately 15 to 20 degrees. In an exemplary embodiment which was built and tested, the leading edge angle of the aslantly disposed surface 19 was approximately 17½ degrees.

Surface 19 expands into the main elongate body portion 20 of the hollow tubular projectile 10. Since the projectile 10 will be fabricated from hard material having an Rc rating of 45 or greater, it is desirable to have a softer, more ductile material such as copper formed as a rotational band 21 about a portion of the elongate main body 20. Band 21 transmits the torque resulting from engagement with the barrel's lands and grooves to projectile 10 as it traverses the barrel of the weapon to impart rotation and hence gyroscopic stability to projectile 10. If conventional copper material is employed for band 21, the same may be affixed to body portion 20 of projectile 10 by various techniques such as swaging, flame spraying, or welded overlay processes. Similarly, a plastic rotational band 21 may be employed as well as other materials, the selection of the rotating material together with the attachment process being dictated by economic and design considerations.

In an exemplary embodiment of the invention which was built and tested, the tubular projectile means 10 weighed approximately 95 grains and was made of steel having a rotational band 21 made of copper and affixed to the main body portion 20 with a thickness of 0.015 inches nominal. In this embodiment, the diameter of the hollow core 17 was approximately 0.297 inches nominal and the thickness T of the steel walls at the main body portion 20 was 0.0616 inches nominal. The angle employed for the aslantly disposed surface 19 was 17.5 degrees, as aforesaid, while, the length L of the main body portion was 0.434 inches. These nominal dimensions are set forth only by way of example as it will be appreciated by those of ordinary skill in the art that variations in nominal dimensions as well as design parameters defined as a function of use will be available, except as regards the critical L/D ratio of 1.5 to 1 discussed above.

Figure 4A:
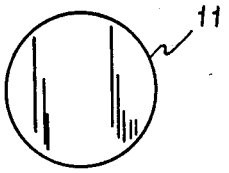
Figure 4B:
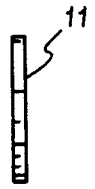

Pusher disc 11 is best shown in FIGS. 4A and 4B which illustrate front and side views thereof, respectively. The pusher disc 11 may be made of steel, plastic, or other relatively hard material which is structurally compatible with the material employed in fabricating the tubular projectile 10. The function of disc 11 is to transmit the propulsive force generated by burning propellant 15 to the tubular projectile means 10 and hence to effectively seal off the hollow core 17 until such time as the tubular projectile means 10 has exited the barrel of the weapon and the full force of the propellant charge 15 has been applied thereto. In sealing off the central core 17 of the tubular projectile means 10, the pusher disc 11 effectively acts as a partial obturator. As will be appreciated by those of ordinary skill in the art, the pusher disc bears upon the surface area at the rear of the tubular projectile means 10 and as shall be seen below is adapted to be seated in an obturator means 12 as shown in FIGS. 5A and 5B.

Figure 5A:
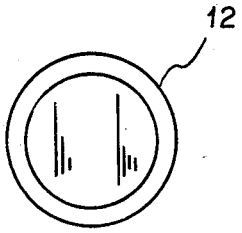
Figure 5B:
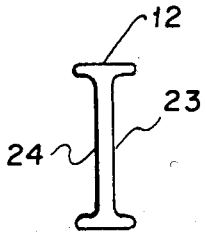
Figure 6:
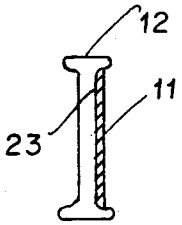
FIG. 6 is a side view showing the pusher disc of FIGS. 4A and 4B mounted within the obturator means shown in FIGS. 5A and 5B.

The obturator means 12 of the embodiment of the improved small arms ammunition according to the present invention is best shown in FIGS. 5A and 5B which illustrate front and side views, respectively, thereof. The obturator means 12 acts to seal off the burning and expanding propellant gases as well as to engage the lands and grooves in the barrel so that the full force of the gases as well as gyroscopic stability is imparted to the tubular projectile means 10 as it is propelled through the barrel. The obturator means 12 is usually fabricated from a suitable plastic material such as high density polyurethane, although any suitable ductile material exhibiting appropriate cost, strength, and fabricating characteristics may be employed. The obturator means 12 is designed at a first side 23 thereof to act as a seat for the pusher disc 11, as shown in FIG. 6, and thus has a cross-section which generally takes on the appearance of an eye (I). This is advantageous because the peripheral portion thereof provides a relatively wide surface for engaging the lands and grooves in the barrel. However, it should be noted that second side 24 or the obturator means 12 is not configured in the same manner as the first side 23 thereof since the first side is adapted to and acts as a seat for the pusher disc 11 while the second side 24 of the obturator means 12 is configured to receive the propulsive forces of the expanding propellant and to serve as a suitable distribution surface therefor so that the expansive force of the propellant is suitably applied to the tubular projectile means 10.

Referring now to FIG. 6, there is shown a side view of the pusher disc 11 seated within the obturator means 12. An inspection of FIG. 6 will reveal to those of ordinary skill in the art that the depth of the seat for the pusher disc 11 within the first side 23 of the obturator means 12 is such that the periphery of the obturator disc 12 extends past the front face of the pusher disc 11 when the same is seated within the obturator means 12 and thus is specially adapted to fit properly around the boattail rear end section of the tubular projectile means 10.

Referring again to FIG. 2, it will be seen that the exemplary embodiment of the improved small arms ammunition according to the present invention is assembled by loading the primed cartridge 9, which is conventional, with approximately the same amount of propellant as for a conventional projectile. Here however, as aforesaid, a propellant which has burning properties more suited to a lighter, tubular projectile means 10 is selected. Thereafter, the tubular projectile means 10 with the pusher 11/obturator means 12 fitted snugly to the rear of the projectile is then inserted into the cartridge case 9. In this manner, a complete round of ammunition is prepared in accordance with the teachings of this invention for use in a weapon.

In operation, when the round is loaded in a weapon and the trigger of the weapon is pulled, the firing pin strikes the primer 14 which then ignites the propellant 15. The burning propellant 15 creates pressure which acts on the rear surface 23 of the obturator means 12 and produces the force that initiates the movement of the pusher 11/obturator means 12 and tubular projectile 10 as an integral unit up the barrel toward the muzzle.

The tubular projectile 10 as illustrated in FIGS. 3A and 3B weighs approximately 95 grains as configured in the exemplary embodiment which was built and tested as set forth above. The addition of the pusher 11/obturator means 12, as illustrated in FIG. 6, adds approximately 14 grains to the mess that must be moved up the barrel in such exemplary embodiment.

Upon firing, the resulting force causes the pusher 11/obturator means 12 and the tubular projectile means 10 to initiate movement, as a unit, up the barrel. This initial motion also brings the rotational band 21 into contact and engagement with the barrel's grooves and the pusher 11/obturator means 12 and the projectile means 10, as a unit, commence rotation as translation up the barrel occurs. Upon exiting at the muzzle, the drag force from air through the center or hollow core portion of the tubular projectile means 10, the air flow about the rear of the unit and the base pressure generated, act in combination to separate the relatively light pusher 11/obturator means 12 from the tubular projectile means 10. The spinning tubular projectile means 11 is thus freed in its trajectory and is gyroscopically stable. This stability, together with the sharp nose design of the projectile, has been proven to be an effective penetrating missile for both unprotected and body armor protected targets.

When considered from the standpoint of accuracy, the caliber 0.45 weapon has always had a rather varied reputation because the average user does not generally obtain good results with this weapon due principally to the rather large and infamous recoil associated therewith. However, when employed with the improved small arms ammunition according to the present invention, impulse or recoil from firing the tubular projectile means 10 is reduced by 15 to 20 percent from that associated with firing conventional rounds. This occurs even though the muzzle velocity for the tubular projectile is in a range of 1400 to 1500 ft/sec or almost twice the muzzle velocity of a conventional round. Thus, while the muzzle velocity of the improved round is markedly increased over that available with conventional rounds, the lighter tubular projectile means 10 results in a markedly reduced impulse or recoil from the weapon. This occurs, as will be appreciated by those of ordinary skill in the art, because momentum transfer or recoil is a function of the projectile mass multiplied by the velocity which in the case of the instant invention is 15 to 20 percent less mass for the tubular projectile means 10 than for a conventional projectile. The reduced impulse or recoil allows the average user to achieve increased accuracy while the marked increase in muzzle velocity results in a significant increase in the effectiveness of the system when viewed from the standpoint of wound ballistics.

The novel characteristics upon which the invention in this case depends relate particularly to the capacity of the projectile 10 to destabilize immediately after impact with soft target media such as gelatin blocks or tissue of like consistency. Thus, bullets or projectiles having relatively high length-to-diameter ratios in excess of 2 to 1, for example, tend to continue along the same path of motion regardless of a change in media. A long slender bullet with a flat linear trajectory moving through still air will tend to continue substantially along the same path upon impacting a gel block. The spin direction of the bullet normally imparted by the barrel rifling when fired from a gun will cause a slight precession of the bullet along a shallow curvature after the bullet enters a gelatin media, but the bullet will not tumble end over end or make any radical departures or perturbations off its pre-established path through air while passing through such media. The long moment arm between the projectile center of gravity and its center of pressure will cause inherent resistance to any change of bullet direction in the same manner than an arrow moving through air does not significantly alter its path of movement when the arrow-tip is abruptly displaced by some lateral force or interference. The arrow shaft and guide fins, being committed to an initial direction involving most of the arrow mass, will continue substantially in that direction and will not tumble end over and regardless of lateral perturbations or changes of media, such as when arrows are shot into water from above the water surface to kill fish.

Because the projectile in this case is substantially lighter than conventional projectiles of corresponding size, its ballistic behavior differs commensurately. Thus, the 0.45 caliber bullet typically weights 230 grains as noted hereinabove, while the novel projectile 10 weighs about 95 grains and the pusher disc about 14 grains. The combined weight of 109 grains in the inventive bullet is less than half of 230 grains, whereby the same propellant force in a cartridge will propel the novel round much faster through a standard M16A1 pistol barrel, with less recoil or reaction force. This increased speed will result in substantially higher rotational speed than the slower conventional bullet passing through the same gun barrel. A lightweight projectile reacts much more violently to changes of media than a heavy bullet, since it lacks as much inertia or momentum. Thus, a ping-pong ball in flight will deflect off a sheet of newspaper whereas a golf ball at the same speed may penetrate the paper and pass through with little or no change of direction.

The higher speed, lighter weight, and short moment arm features of the novel bullet in this case combine to produce abrupt destabilization of the bullet in this case when used against soft targets such as gelatin and targets of like consistency. Thus, while the bullet is stabilized in flight by its spin motion, it will tumble rapidly and swerve sharply off a linear path upon impact with the target, whereas conventional bullets will pass through the same material and exit out the back side thereof, retaining much of its energy. In contrast, the novel bullet, being unstable in the target media, will deposit its entire energy content therein and usually never exits the target mass at all.

While projectile 10 may be made of various different materials, a hard, rigid and incompressible material is preferred. Also, in any case, the nose portion comprising edge 18 and surface 19 should have a Rockwell hardness rating Rc of 45 or above, with a range of 45 to 60 being preferred. Also, while leading edge 18 is preferably sharp-edged, it may be slightly rounded as long as it concentrates substantially on the stress load on the target surface in a localized area such as to exceed the normal tensile strength of the target material, which produces fracture thereof so that the projectile 10 penetrates through the target surface. Also, the inner diameter of hole 17 should not be less than one-third of the outside diameter of projectile main body portion 20, with a preferable range of $\frac{1}{2}$ to $\frac{1}{3}$ of such outside diameter. This is because a center hole 17 which is too small will not appreciably reduce the bullet mass as necessary to achieve substantial increase in muzzle velocity, and because a relatively small hole tends to behave aerodynamically and ballistically like a conventional projectile with no hole at all, especially regarding the terminal ballistic behavior thereof.

Although the present invention has been disclosed in connection with a rather specific exemplary embodiment thereof, various alternatives and modifications to the specific structure set forth herein will be obvious to those of ordinary skill in the art. For instance, the tubular projectile means employed within the instant invention together with its accompanying pusher/obturator means may be sealed up or down to accommodate other conventional forms of cartridge cases for use with other types of hand guns. Thus, the subject invention should not be viewed as limited or exclusively intended for use with the U.S. Army M1911A1 pistol. Additionally, various modifications in the dimensions of the hollow tubular projectile means may be made to specially adapt this projectile for particular uses or application and variations in the parameters of the rotational band, the pusher disc, and/or the obturator means will readily occur to those of ordinary skill in the art. For instance, rather than employing the rotational band disclosed, the outside of the tubular projectile means may be gilded, integral pusher disc/obturator means may be employed, or varying dimensional changes may be implemented without significant deviation from the concepts taught herein.

While this invention has been described in connection with a preferred exemplary embodiment thereof, it will be understood that many modifications will be readily apparent to those of ordinary skill in the art; and that this application is intended to cover any adaptations or variations thereof. Therefore, it is manifestly intended that this invention be only limited by the claims and the equivalents thereof.

I claim:

1. Small arms ammunition consisting essentially of:
primed cartridge case means;
a substantially cylindrical hollow tubular projectile positioned in said cartridge case,
said projectile having a main body portion and a nose portion having an aslantly disposed surface tapering down from said main body portion toward an annular leading edge.
said leading edge having a diameter from ⅓ to ½ of the outer diameter of said substantially cylindrical hollow tubular projectile,
an inner axial concentric passage through said hollow tubular projectile,
said passage having substantially uniform inner diameter corresponding with said leading edge diameter,
the length of said tubular projectile being between 1.5 to 1.75 times said outer diameter of said tubular projectile,
said main body portion of said hollow tubular projectile means having rotational band means disposed about a peripheral portion thereof, a pusher/obturator means snugly fitted to said main body portion of said hollow tubular projectile having a rear portion thereof disposed within said primed cartridge case means,
said obturator having a flat disc-like body with a peripheral flange leg portion extending circumferentially in the form of an H, and said pusher having a flat disc-like body seated between said flange legs of said obturator body.

2. Small arms ammunition consisting essentially of:
primed cartridge case means;
a substantially cylindrical hollow tubular projectile positioned in said cartridge case,
said projectile having a main body portion and a nose portion having an aslantly disposed surface tapering down from said main body portion toward an annular leading edge.
said leading edge having a diameter from ⅓ to ½ of the outer diameter of said substantially cylindrical hollow tubular projectile,
an inner axial concentric passage through said hollow tubular projectile,
said passage having substantially uniform inner diameter corresponding with said leading edge diameter,
the length of said tubular projectile being 1.5 times said outer diameter of said tubular projectile,
said main body portion of said hollow tubular projectile means having rotational band means disposed about a peripheral portion thereof, a pusher/obturator means snugly fitted to said main body portion of said hollow tubular projectile having a rear portion thereof disposed within said primed cartridge case means,
said obturator having a flat disc-like body with a peripheral flange leg portion extending circumferentially in the form of an H, and said pusher having a flat disc-like body seated between said flange legs of said obturator body.

3. Small arms ammunition consisting essentially of:
primed cartridge case means;
a substantially cylindrical hollow tubular projectile positioned in said cartridge case,
said projectile having a main body portion and a nose portion having an aslantly disposed surface tapering down from said main body portion toward an annular leading edge.
said leading edge having a diameter from ⅓ to ½ of the outer diameter of said substantially cylindrical hollow tubular projectile,
an inner axial concentric passage through said hollow tubular projectile,
said passage having substantially uniform inner diameter corresponding with said leading edge diameter,
the length of said tubular projectile being 1.75 times said outer diameter of said tubular projectile,
said main body portion of said hollow tubular projectile means having rotational band means disposed about a peripheral portion thereof, a pusher/obturator means snugly fitted to said main body portion of said hollow tubular projectile having a rear portion thereof disposed within said primed cartridge case means,
said obturator having a flat disc-like body with a peripheral flange leg portion extending circumferentially in the form of an H, and said pusher having a flat disc-like body seated between said flange legs of said obturator body.

* * * * *